US006092397A

United States Patent [19]

Cortinovis

[11] Patent Number: 6,092,397

[45] Date of Patent: Jul. 25, 2000

[54] SOCK FOR THE LONG-LEGGED PERSON

[75] Inventor: Giulio Cortinovis, Collebeato, Italy

[73] Assignee: Sockwise Inc, Tucson, Ariz.

[21] Appl. No.: 09/225,086

[22] Filed: Jan. 4, 1999

[51] Int. Cl.[7] ..... D04B 11/00

[52] U.S. Cl. ..... 66/184; 66/183; 66/178 R; 2/239

[58] Field of Search ..... 66/178 R, 183, 66/184–185, 186, 187, 178 A; 2/239, 240, 241

[56] References Cited

U.S. PATENT DOCUMENTS

| | | | |
|---|---|---|---|
| 2,169,203 | 8/1939 | Hinchliff | 66/178 A |
| 3,975,929 | 8/1976 | Fregeolle | 66/178 A |
| 4,027,667 | 6/1977 | Swallow et al. | 66/178 A |
| 4,048,818 | 9/1977 | Cueman | 66/178 A |
| 4,180,065 | 12/1979 | Bowen | 66/178 A |
| 4,240,160 | 12/1980 | Imboden et al. . | |
| 4,253,317 | 3/1981 | Howard et al. . | |
| 4,397,161 | 8/1983 | Chesebro, Jr. et al. . | |

FOREIGN PATENT DOCUMENTS

| | | | |
|---|---|---|---|
| 2213677 | 8/1974 | France | 66/178 A |

*Primary Examiner*—Danny Worrell
*Attorney, Agent, or Firm*—McGlew and Tuttle, P.C.

[57] ABSTRACT

A long-legged sock is provided that includes a cuff section and a calf section incorporating a first elastic thread together with a basic thread. Also provided is an ankle section incorporating the first elastic thread and a second elastic thread together with the basic thread; an instep area incorporating the second elastic thread and a third elastic thread together with the basic thread; and a foot section incorporating the third elastic thread together with the basic thread.

7 Claims, 1 Drawing Sheet

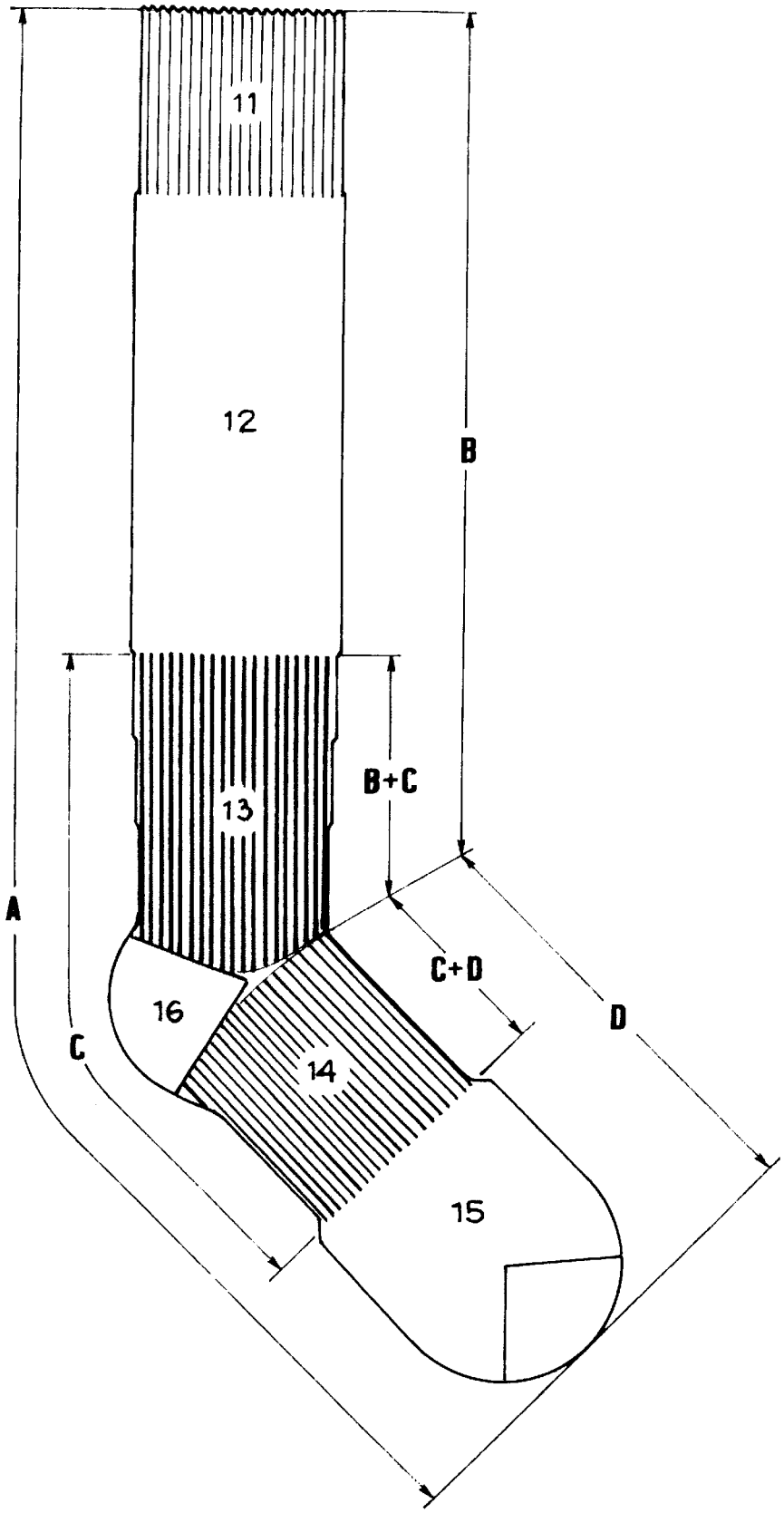
11
12
13
14
15
16
A
B
B+C
C
C+D
D

SOCK FOR THE LONG-LEGGED PERSON

FIELD OF THE INVENTION

The present invention pertains to socks, in particular to socks for the long-legged person to be worn daily (daily sock) and having therapeutic value at least for some circulatory conditions.

BACKGROUND OF THE INVENTION

Socks used mostly for sports activities which have sections that differ from zone to zone in type of stitch and/or degree of elasticity are currently known. For example, U.S. Pat. No. 4,253,317 describes a short-legged sock for athletic use intended for the functions of compression and support of the arch, instep and ankle of the person wearing it. Such a sock comprises: a cuff; an upper imitation-ribbed part made by knitting an elastic thread with a basic thread; an instep-ankle section made with the said basic and elastic threads as in the upper part, but with the addition of internal terry loops of a certain prism density made with an additional thread; a heel section made without elastic thread, with the basic thread and with an additional thread for an internal terry stitch of another density; and a tip section which is knitted with the basic thread and a terry thread on the inside.

Therefore, only one elastic thread is used in the manufacture of such a sock in the upper-part and instep-ankle areas.

U.S. Pat. No. 4,397,161 also pertains to a short-legged sock having a leg section and a foot section, elasticized for a compression and a support function of the foot of the person wearing it. This sock is manufactured by knitting a basic thread and incorporating an elastomeric thread in the areas of the leg and of the foot with an elastomeric thread density greater in the foot section than in the leg section.

Therefore, only one elastic thread is used here as well, even though it has a density that is different from one part to another.

In addition, a so-called containment sock is known from U.S. Pat. No. 4,240,160 which can be used to keep the venous and lymphatic pressures at the ends of the lower limbs normal. However, the sock is produced by recutting a piece of elastic stitch and by sewing the recut outline in a direction and with a shaping that are suitable for making it possible for the sock to perform the function for which it has been provided.

SUMMARY AND OBJECTS OF THE INVENTION

Based on the above-mentioned, one object of the present invention is to provide a sock for the long-legged person that has therapeutic value and has specific sections for the calf, ankle-instep area and tip of the foot, which is made by using, in addition to at least one basic thread, three different elastic threads incorporated selectively during the knitting individually or combined in a pair.

Therefore, the sock manufactured has specific sections which differ in a different degree of elasticity, which derives not from a different density of insertion of a single elastic thread, but from the selective insertion of more elastic threads, which have different elasticities and/or strengths and which combine their elastic effect in some sections of the sock, because two elastic threads are present at the same time.

The sock will have practically along its length four sections which are functional and have a different effect on the lower limb on which it is worn:

- a calf section incorporating a first elastic thread which has a first degree of elasticity;
- an ankle section incorporating in a combined manner the first elastic thread and a second elastic thread which has a second degree of elasticity;
- a section for instep and dorsal and plantar area, incorporating in a combined manner the second elastic thread and a third elastic thread that has a third degree of elasticity;
- a tip-of-the-foot section incorporating the third elastic thread.

The first elastic thread preferably has a strength that is greater than that of the third thread [sic, 'dilo' should be filo—Tr.Ed.], and the ankle and instep sections are made of vertical ribbed stitches.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWING

In the drawing:

The only figure is a schematic representation of a sock according to the present invention, viewed from the side and in a flat state.

DESCRIPTION OF THE PREFERRED EMBODIMENT

The sock according to the present invention comprises a border or cuff 11, a calf-leg section 12, an ankle area 13, an instep area 14, and a tip-of-the-foot section 15.

The sock is produced on a circular sock knitting machine by means of a prior-art knitting method, which is known to persons skilled in the art, but with a suitable selection of the threads to be used in the different sections of the sock, starting from the border or cuff up to the end of the tip of the foot.

In particular, the sock is produced by using at least one basic thread A along the entire length of the sock, and selectively, three elastic threads B, C, D, which differ in elasticity and/or strength.

The basic thread A may be made of wool, cotton or a synthetic material. It is knitted together with a first elastic thread, in the manufacture of the border or cuff 11 and in the calf-leg section of the sock. The cuff 11 may be in ribbed stitch, as usual; the calf-leg section 12 may be in plain stitch.

At the end of the calf zone 12, or at the beginning of the ankle area 13, a second elastic thread C that is different from the first one is knitted together with the basic thread A and with the first elastic thread B. At the end of the ankle area 13 the heel 16 of the sock is made in the usual manner, after which the instep area 14 starts. At that point, insertion of the first elastic thread B stops, the instep area 14 is produced by knitting together the basic thread A, the second elastic thread C and the third elastic thread D. At the end of this instep area 14, insertion of the second elastic thread C stops, and manufacture of the sock continues in the tip-of-the-foot section 15 by then knitting only the third elastic thread D together with the basic thread A. Preferably, the ankle 13 and instep 14 areas are in ribbed stitch (both in the plantar part and in the dorsal part, while the tip section is in plain stitch).

In the drawing, the parts of the sock that are made by using the basic thread with a single thread or with two elastic threads at the same time in a selective manner are shown by the same A–D.

Some parts of the instep and/or the tip areas may also be knitted with terry loops, particularly on the inside of the sole. Preferably as well, the ankle area will be made of a graduated stitch in order to form an upside-down cone so as to follow the anatomical shape of the leg.

The finished sock will have the calf 12 and tip-of-the-foot 15 sections made with the same type of stitch, but with a different degree of elasticity due to the difference between the first and the third elastic threads B, D; the ankle area 13 will have a first degree of elasticity due to the presence of the first and second elastic threads B, C; the instep area 14 will in its turn have another degree of elasticity due to the fact of the second and the third elastic threads C, D being incorporated.

The sock thus manufactured, particularly with its sections of different elasticity, represents an innovation from the viewpoint of the structure and of the functionality of the piece of clothing.

Worn daily, the sock has benefits both for the person who is frequently moving and for the person who is more sedentary. While walking, the sections of different elasticity, especially the ankle-to-instep area, constitute a support which helps the natural movement of the foot, stimulating and aiding the blood circulation.

A similar support and compression effect may likewise be found in the static phases of sitting or in the upright position of the person wearing the sock. Actually, even the smallest movements of the feet are utilized by the sections of different (variable) elasticity of the sock, having a positive effect on the venous and lymphatic pressure of the limb.

The results, which are also clinically proven, have shown improvements in the blood flow from the lower limbs, preventing swelling especially of the ankle and resulting states of heaviness and fatigue. Improvements were also found in the problems caused both by the disease of diabetes, in particular if the sock has a terry sole, and by arthrosis and rheumatism. While a specific embodiment of the invention has been shown and described in detail to illustrate the application of the principles of the invention, it will be understood that the invention may be embodied otherwise without departing from such principles.

What is claimed is:

1. A long-legged sox, comprising:

a border or cuff;

a calf-leg section;

an ankle area;

an instep area, and a tip-of-the-foot section, said cuff, said sections and said areas being knitted with at least one basic thread and with the insertion of elastic threads, at said calf-leg section, said ankle area, said instep area, and said tip-of-the-foot section have a degree of elasticity that is different from each other, each incorporating at least one said elastic thread that has a different elasticity or strength from each other, said border or cuff and said calf section incorporate a first elastic thread together with said basic thread, said ankle area incorporates said first elastic thread and a second elastic thread with said basic thread, said instep area incorporates said second elastic thread and a third elastic thread together with said basic thread, and the said foot section incorporates said third elastic thread together with said basic thread.

2. The sock in accordance with claim 1, wherein said first elastic thread has a strength that is greater than that of said third elastic thread.

3. The sock in accordance with claim 1, wherein said ankle area and said instep area have vertical ribbed stitches.

4. The sock in accordance with claim 1, wherein said instep area and said tip-of-the-foot section have at least one sole with said terry loops on the inside.

5. A method for manufacturing on a circular sock knitting machine a long-legged sox, comprising the steps of:

knitted from one end to the other with at least one basic thread, starting from a border or cuff to terminate at the tip of the sock through a calf-leg-ankle section, an instep area and a tip-of-the foot section without interruption;

using in combination with said basic thread a first elastic thread having a first degree of elasticity in said border or cuff and in said leg section;

said first elastic thread together with a second thread having a second elasticity in said ankle area;

said second elastic thread together with a third elastic thread having a third degree of elasticity in said instep area; and said third elastic thread in said tip-of-the-foot section.

6. The method in accordance with claim 5, wherein said first elastic thread has a strength greater than that of said third elastic thread.

7. The method in accordance with claim 5, wherein a thread is incorporated at least in said instep and said tip-of-the-foot areas in order to form said terry loops on the inside.

* * * * *